US005242370A

United States Patent [19]

Silver et al.

[11] Patent Number: 5,242,370

[45] Date of Patent: Sep. 7, 1993

[54] CENTRIFUGE

[75] Inventors: Jerry B. Silver, Newport Beach; Edward E. Elson, Anaheim, both of Calif.

[73] Assignee: Davstar California, Inc., Newport Beach, Calif.

[21] Appl. No.: 849,742

[22] Filed: Mar. 12, 1992

[51] Int. Cl.[5] ..... B04B 9/10

[52] U.S. Cl. ..... 494/11; 494/16; 494/37; 494/60

[58] Field of Search ..... 494/16, 17, 18, 19, 494/20, 60, 37, 31, 61, 7, 11; 210/781, 782, 360.1; 422/44

[56] References Cited

U.S. PATENT DOCUMENTS

| | | | |
|---|---|---|---|
| 3,720,368 | 3/1973 | Allen | 494/60 |
| 4,193,536 | 3/1980 | Kubota | 494/16 |
| 4,221,325 | 9/1980 | Kubota | 494/60 |
| 4,226,669 | 10/1980 | Vilardi | 494/16 |
| 4,244,513 | 1/1981 | Fayer | 494/11 |

*Primary Examiner*—Robert W. Jenkins
*Attorney, Agent, or Firm*—Michael J. Ram

[57] ABSTRACT

An automatic centrifuge, especially useful with the Censlide TM containers, enables automatic operation in the centrifuging of samples. The centrifugal speed is ramped up to a first speed for about 45 seconds, the first speed maintained for about 15 seconds, the speed is then ramped down to a second speed during a 15 second time interval, and the second speed maintained while the samples are flicked a predetermined number of times. The centrifugal speed is then ramped down to zero. The automatic operation, and flicking enables the samples to be examined in their containers as soon as the automated cycle, requiring a time period of from one and one half minutes to about two minutes, is ended.

34 Claims, 13 Drawing Sheets

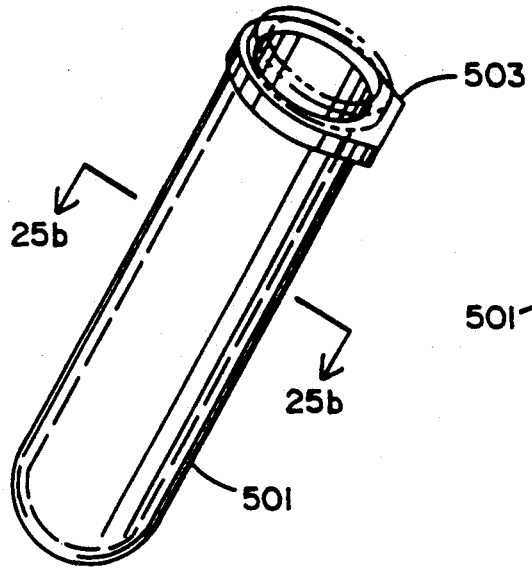
FIG. 25a
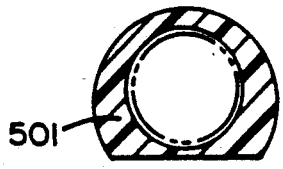
FIG. 25b
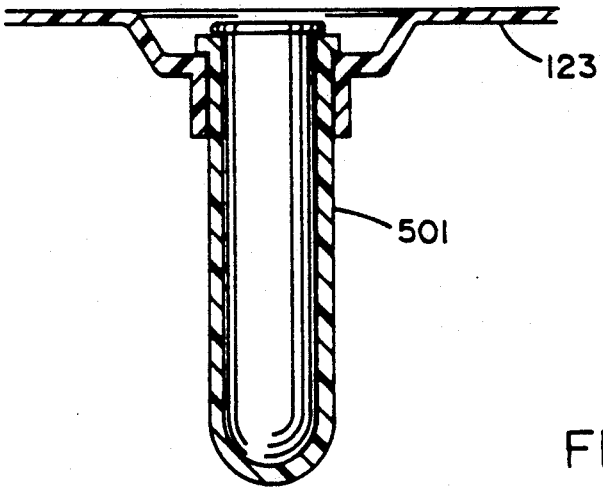
FIG. 26
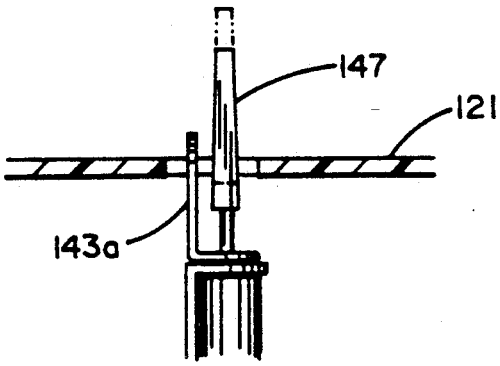

CENTRIFUGE

BACKGROUND OF THE INVENTION

The present invention relates to centrifuge devices, and more particularly to an automated laboratory centrifuge which is used in combination with a combination specimen container and microscope slide. One such combination specimen container and microscope slide is described in U.S. Pat. No. 5,030,421, and is currently commercially available under the name Censlide TM. Such combination specimen containers and microscope slides are referred to as Censlide containers.

The use of centrifuges in laboratories to separate solids from biological fluids is widespread. In small clinics and physician offices, procedures such as performing urinalysis are time consuming, unstandardized and costly. The centrifuge of the present invention, with its Censlide container reduces procedural time, increases standardization of testing and reduces cost to enable small labs to become more profitable and possibly reducing costs for the patient.

Using the standard urinalysis method, urine is poured into a centrifuge tube, which is typically an ordinary test tube. The centrifuge tube is centrifuged for five minutes and the supernatant (liquid portion above the sediment) is poured off leaving a small volume of urine on top of the pellet (sediment). A pipette is introduced into the centrifuge tube and the pellet is re-suspended by aspirating and dispelling the sediment suspension. A small volume is aspirated into a pipet and one drop of the suspension is placed on a microscope slide. A coverslip is then placed over the drop and the slide is microscopically examined. The elements within the urine are determined by morphological features and thus the urinalysis is performed.

An improvement of this basic procedure is described in U.S. Pat. No. 5,030,421, to Louis F. Muller, entitled "Integral Centrifuge Tube and Specimen Slide." In the Muller patent, the Censlide container (tube) is described as having an upper, hollow, generally tubular portion which serves as a specimen collection member. The same tube also has a central specimen collection space in communication with the upper end of the container. This device also includes a lower integral microscope slide member having transparent flat front and rear walls throughout a part of its length, and which is in communication with the upper specimen collection space.

The transition for the specimen collection space to the microscope slide member is smooth, and the entire unit operates as an integral centrifuge tube and specimen slide. An internally fitting cap or closure is provided at the upper end of the container. Thus, once the sample is taken, it may be centrifuged and examined without having to re-open the container, or otherwise transfer the materials within the container.

Although the Censlide container has structures designed to facilitate the formation of a desired evenly spread array of centrifuged elements across its microscope slide member, packing may nonetheless occur if the centrifugation occurs for too long a time, or if the centrifugal force is sufficient to deform the microscope slide member of the container. In the event of packing it is desirable to tap or flick the Censlide container to disperse the packed material. This dispersion by a flicking action produces a more even distribution of the sediment across the microscope slide member portion of the tube.

Finger flicking of the Censlide container often does not allow enough energy input into the microscope slide member of the Censlide container to dislodge packed material. In addition, the technique of manual flicking varies from individual to individual, causing the lack of standardization of the dispersal of the packed material. Manual flicking of the Censlide container may also create scratches or deform the microscope slide member portion viewing area, which can interfere in microscopic examination.

Most existing and currently available centrifuges must be timed during centrifugation and calibrated to the appropriate relative centrifugal force to ensure that adequate separation occurs without excessive packing. It is currently necessary for a lab technician to manually time these centrifuges with a timer, therefore increasing labor costs and increasing the chance of human error, and adding more variables to standardizing the technique.

The present invention addresses the above problems by automating and thereby standardizing the urinalysis procedure.

SUMMARY OF THE INVENTION

The present invention is an automated centrifuge that may be used in combination with the Censlide container for urinalysis. The centrifuge spins the Censlide container and creates a dispersed sediment within the tubes. It further flicks the ends of the tubes to disperse and evenly distribute the sediment within the slide portion of the container. When used with the more common centrifuge tubes for centrifugation of other fluids, the dispersion flicking mechanism is not activated. In routine operation of the container, a lid which seals the rotor head of the centrifuge is manually opened. A Censlide container is filled with urine, capped and then placed in a specially configured rotor head that accepts the shape of the Censlide container for proper orientation. One to six Censlide containers ca be placed within the rotor. When the lid is closed, a controller enables the start activation. A start button is provided to initiate centrifugation. At the initiation of centrifugation, the centrifuge lid is locked shut, to prevent its accidental opening. The centrifugal speed is allowed to accelerate to 1600 to 1700 rpm over a period of about 45 seconds. The speed is maintained for about 15 seconds. At the end of this initial 60 second time interval the motor is slowed down and the rotor decelerates to a speed of approximately 400 to 500 rpm. A disperser or flicker is then activated that touches the end (bottom slide portion) of the Censlide container causing a flicking action to disperse any sample sediment present. The tubes are then each flicked a predetermined number of times while the motor is controlled to maintain the 400 to 500 rpm speed during the flicking or dispersal portion of the cycle. At the completion of the flicking or dispersal portion of the cycle the rotor is further decelerated to a complete stop. When the rotor comes to a complete stop, the locking mechanism is released, and the centrifuge can then be opened.

The centrifuge of the present invention eliminates the need to flick the tube by hand, enables a more uniform distribution of sediment and helps further standardize the urinalysis procedure. It therefore reduces handling time, lab technician exposure to bodily fluids, decreases cost and helps increase the accuracy of the test. Without the use of the centrifuge of the present invention, flicking with fingers is necessary and can be problematic increasing the possibility of technician error.

BRIEF DESCRIPTION OF THE DRAWINGS

Other aspects, features and advantages of the invention, its configuration, construction, and operation will be best understood from the following detailed description, taken in conjunction with the accompanying drawings in which:

FIG. 25*a* is a perspective view and FIG. 25*b* is a sectional view of an alternative configuration with an adaptor in combination with a standard centrifuge tube, which can be used in conjunction with the centrifuge of the present invention; and FIG. 26 is a side sectional view of the adapter and centrifuge tube of FIG. 25 mounted in the centrifuge of the present invention.

DETAILED DESCRIPTION OF THE PREFERRED EMBODIMENT

Figure 1:
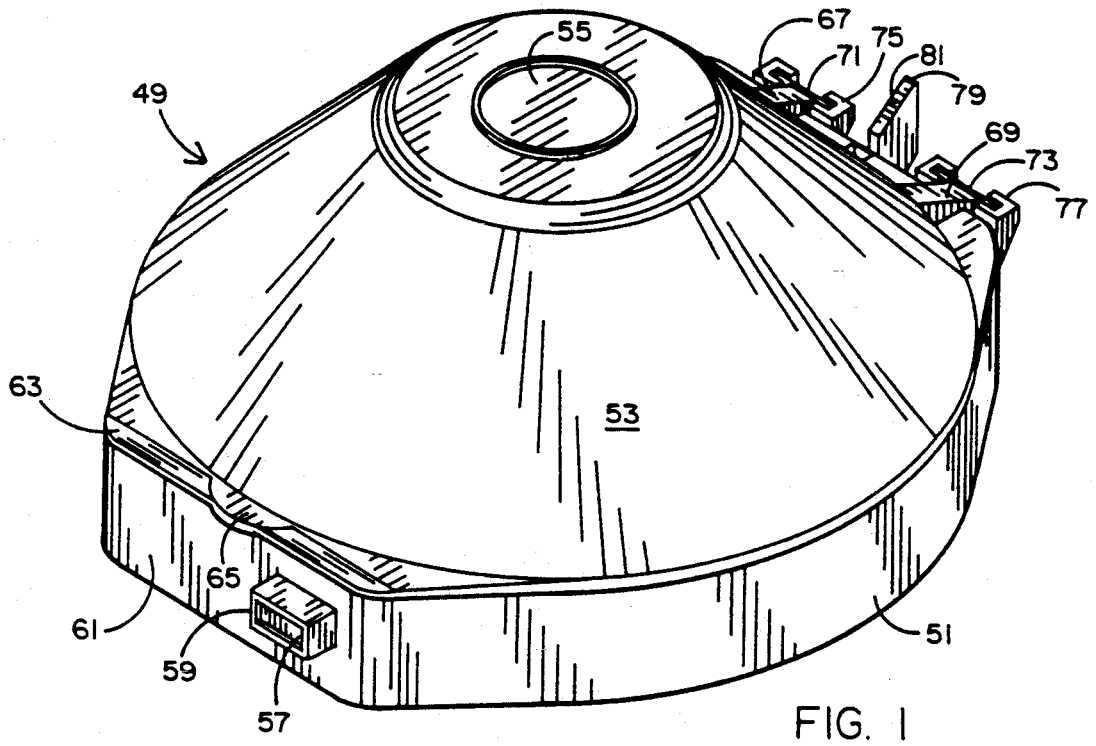
FIG. 1 is a perspective view of the centrifuge of the present invention illustrating the front and right side of the centrifuge in its closed position.

Referring to FIG. 1, the centrifuge 49 of the present invention includes a centrifuge housing 51 and a pivotally attached lid 53. Lid 53 has an upper, generally flat portion 55 suitable for labels, writing, instructions, etc. At the front of centrifuge housing 51 is an illuminateable indicator switch 57. Indicator switch 57 may be surrounded by a switch guard 59 to inhibit accidental actuation of indicator switch 57.

The front of centrifuge housing 51 includes a flat portion 61 through which the indicator switch 57 is mounted. Similarly, the front of lid 53 includes a linear lip 63 which extends generally parallel to flat portion 61, and overhangs flat portion 61 to a limited extent. At the center of the extension of linear lip 63 is a rounded tab 65 which provides a differentially greater, but limited overhang with respect to flat portion 61.

At the rear portion of lid 53, a pair of hinge projections 67 and 69 terminate in a pair of pins 71 and 73, respectively. Pins 71 and 73, which are collinear, engage a pair of hinge sockets 75 and 77, respectively. Supported by the centrifuge housing 51 at a point between the hinge sockets 75 and 77 is a raised stop 79. Raised stop 79 has a surface 81 which is complimentary to the surface of lid 53 when lid 53 is in the raised position. As will be shown, lid 53 rests against raised stop 79 when it is in the raised position.

Figure 2:
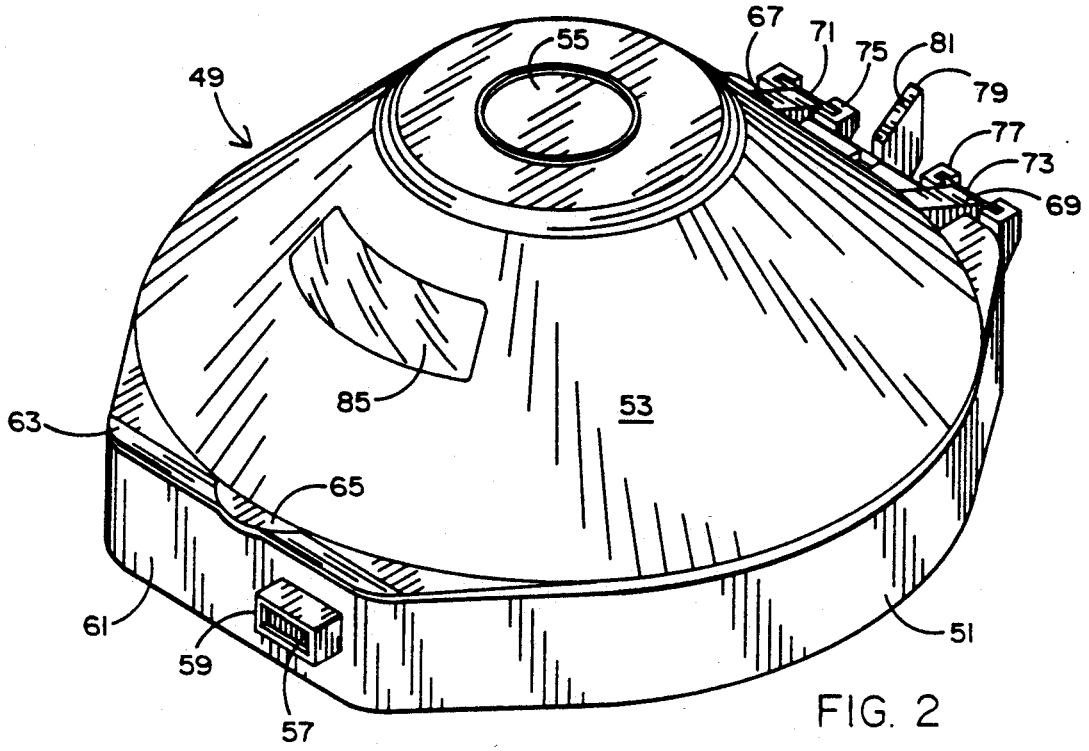
FIG. 2 is a perspective view of the centrifuge of the present invention, similar to that illustrated in FIG. 1, but illustrating a second embodiment of the lid having a clear view port.

Referring to FIG. 2, an alterative embodiment for the lid 53 is illustrated. A clear view port 85 is located about ⅔ way vertically up the surface of lid 53. In the event that lid 53 is molded as a single piece of clear plastic, view port 85 can be formed by polishing smooth a section of a textured mold in the shape of the view port 85 desired. In the event that the lid 53 is to be made of non-clear plastic, view port 85 could be formed by forming a space in the lid 53 and fixably inserting an area of clear material to form view port 85. The other aspects of FIG. 2 are identical to those of FIG. 1.

Figure 3:
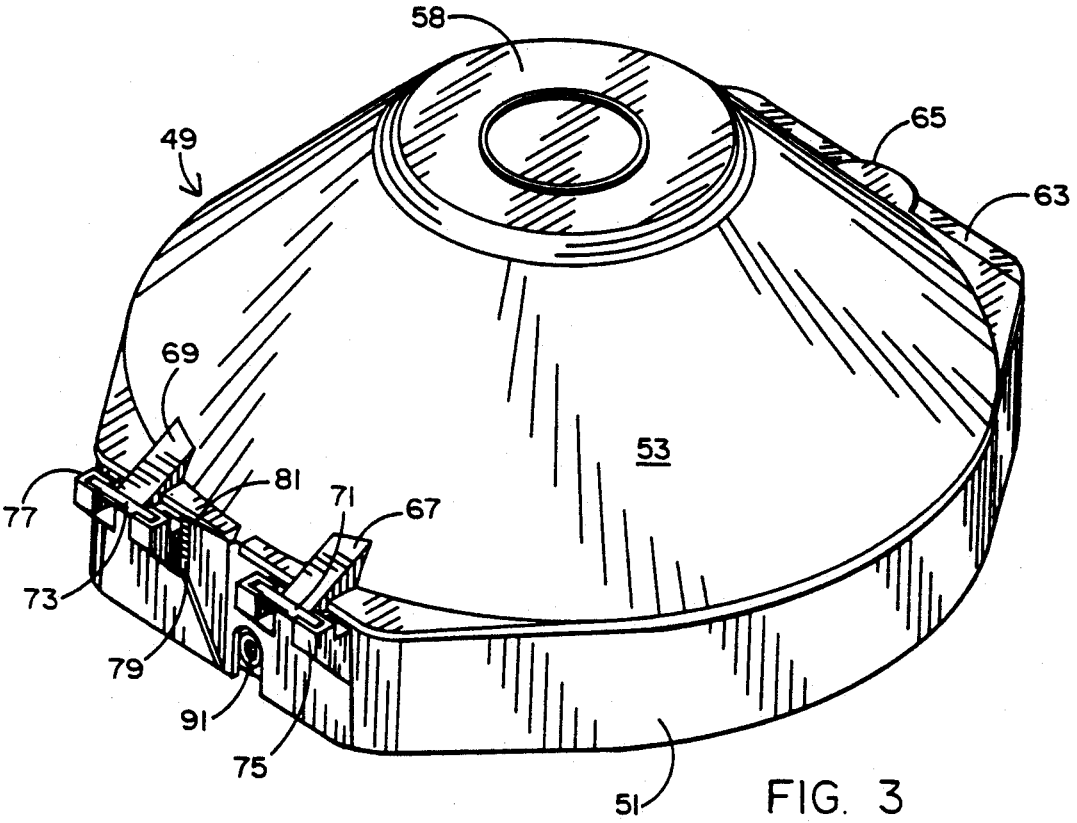
FIG. 3 is a perspective view of the centrifuge of the present invention illustrating the rear and left side of the centrifuge in the closed position.

Referring to FIG. 3, a rear perspective view of the centrifuge 49 illustrates a greater detail of the hinge projections 67 and 69, pair of pins 71 and 73, hinge sockets 75 and 77 and the raised stop 79. To one side of the raised stop 79 is located a power input jack 91.

Preferably the input power will be supplied by a wall plug transformer having a voltage output in the range of about 6 to 24 volts direct current, a safe operating voltage. However, it is understood that the power requirements will be dictated by the size and speed requirements of the particular centrifuge 49 required for the task for which it is employed.

Figure 4:
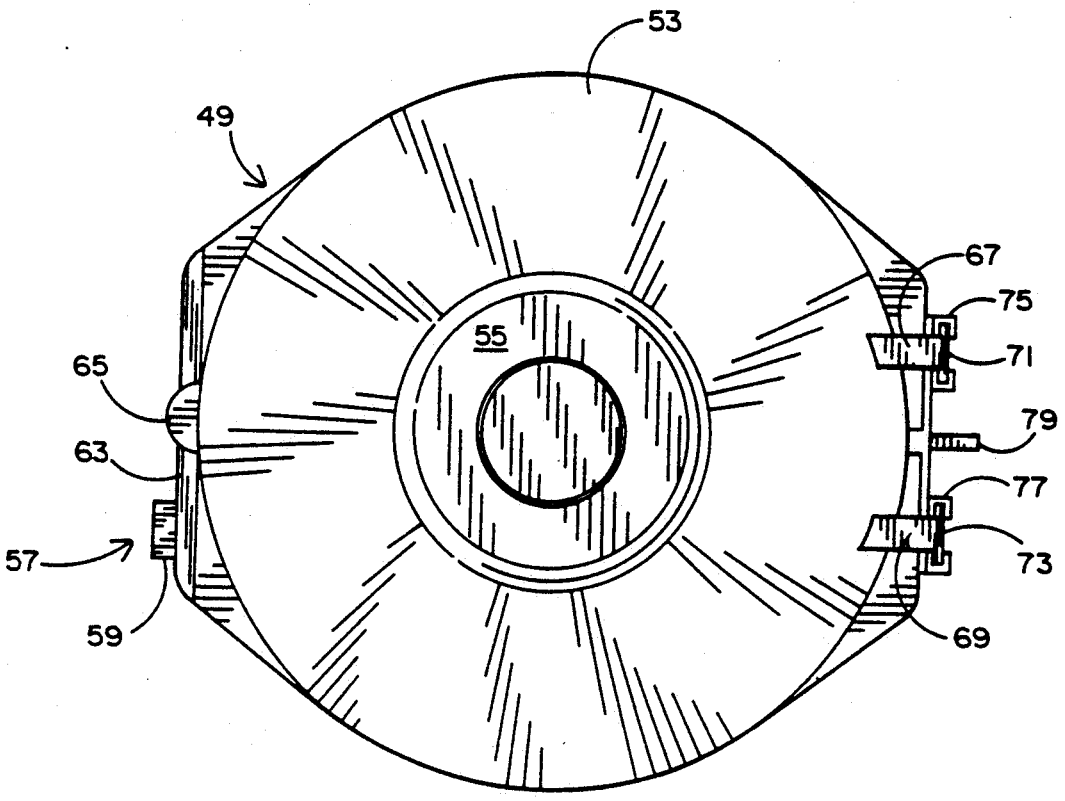
FIG. 4 is a top view of the centrifuge of FIGS. 1 and 3.

Referring to FIG. 4, a top view of the centrifuge 49 illustrates the extent to which the flat portion 61 and linear lip 63, and the hinge projections 67 and 69, pair of pins 71 and 73, hinge sockets 75 and 77, and the raised stop 79 extends beyond the circular form of the centrifuge.

Figure 5:
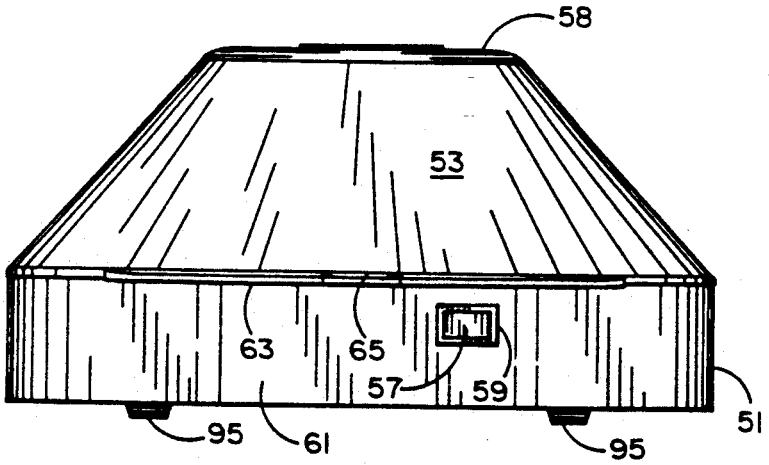
FIG. 5 is a front view of the centrifuge of FIGS. 1, 3, and 4, in the closed position.
Figure 6:
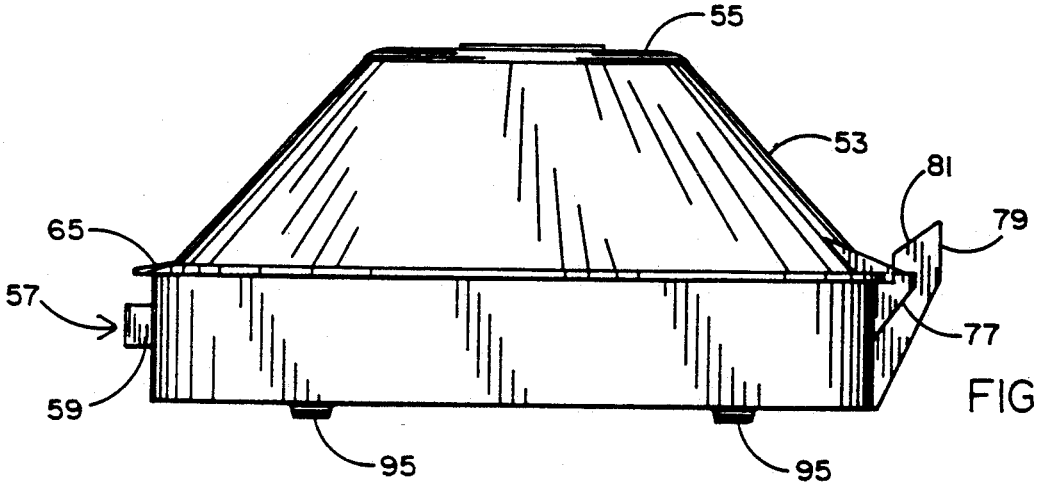
FIG. 6 is a side view of the right side of the centrifuge of FIGS. 1, 3, 4, and 5 in the closed position.
Figure 7:
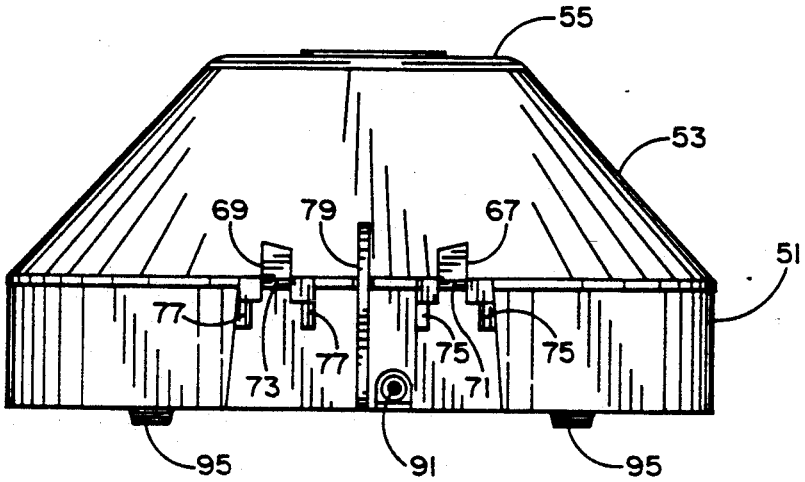
FIG. 7 is a side view of the rear side of the centrifuge of FIGS. 1, 3, 4, 5, and 6 in the closed position.

Referring to FIG. 5, a front view of the centrifuge 49 reveals the presence of four feet 95 (only two will be visible in each of the FIGS. 5–7). Feet 95 are typically rubber or synthetic rubber or other polymeric materials and provide a more stable frictional anchoring with respect to the surface on which centrifuge 49 rests. For increased anchoring, suction cup feet may be utilized.

Referring to FIG. 6, the surface 81, formed to complement the surface of lid 53 is best shown. Also shown is the extent to which rounded tab 65 extends over the centrifuge housing 51. Referring to FIG. 7, the physical locations of the hinge projections 67 and 69, pair of pins 71 and 73, hinge sockets 75 and 77, and the raised stop 79 are shown.

Figure 8:
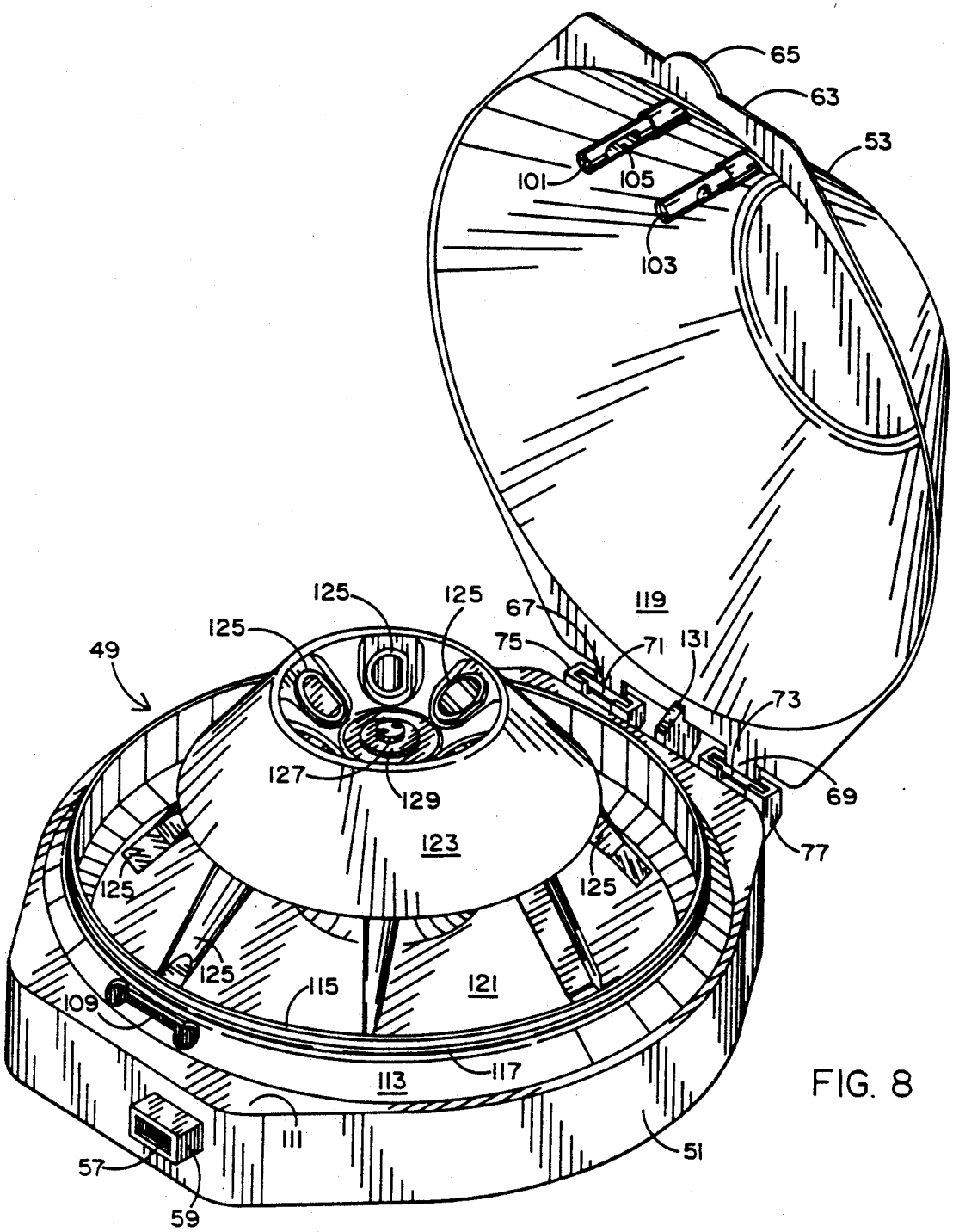
FIG. 8 is a perspective view of the centrifuge of FIGS. 1, 3 and 4 illustrating the front and right side of the centrifuge in its open position.

Referring to FIG. 8, the centrifuge 49 is shown with the lid 53 in raised position. The lid 53 has a pair of downwardly projecting latch rods 101 and 103. Latch rod 101 has an aperture 105 extending at right angles to its axis and extending completely through latch rod 101. Latch rod 103 is filled with a magnetic material 104 at a point along its length about even with the aperture 105. This magnetic material 104 is positioned such that the magnetic field is generally parallel to the axis of the aperture 105.

Centrifuge housing has a barbell shaped aperture 109, the ends of which are positioned to accept the downwardly projecting latch rods 101 and 103. Barbell shaped aperture 109 forms the entrance to a latch mechanism which will be discussed below.

The centrifuge housing 51 has an upwardly disposed, upper flat surface 111 which engages the lower surface of linear lip 63 and the lower surface of lid 53. Adjacent this flat surface 111 is a beveled surface 113. At the upper edge of beveled surface 113, and concentrically inwardly of the upper edge of beveled surface 113, a rim 115 is supported by the beveled surface 113 portion of the centrifuge housing 51. An "o" ring 117, or other compressible seal, is supported between the rim 115 and the upper edge of the beveled surface 113. This "o" ring 117 is situated to engage the inner surface 119 of the lid 53 when lid 53 is closed with respect to centrifuge housing 51.

Within the centrifuge housing 51, and concentrically within the rim 115, is a centrifuge bowl 121 area. Within the centrifuge bowl 121, a container support 123 is rotatably supported. Container support 123 is illustrated supporting six Censlide containers 125, which will be discussed in greater detail in FIGS. 11–14. Hereafter, the Censlide containers will be referred to as containers 125. Container support 123 can hold up to six containers 125, but for balance purposes, it should support either two, or four symmetrically placed containers 125, or six containers 125. Note that the top rim of the containers 125 are not completely circular.

At the concentric center of the container support 123 is a locking screw 127 engaging a washer 129 or other retaining means. Locking screw 127 engages the shaft of a centrifuge motor, which will be shown in subsequent Figures. At the rear of the centrifuge 49, a small slot 131 in the lid 53 accommodates the surface 81 of the raised stop 79, to enable surface 81 to rest flatly against the outer surface of lid 53. Also shown are the pivotal engagement of the hinge projections 67 and 69 and their connecting pair of pins 71 and 73, with respect to hinge sockets 75 and 77.

Figure 9:
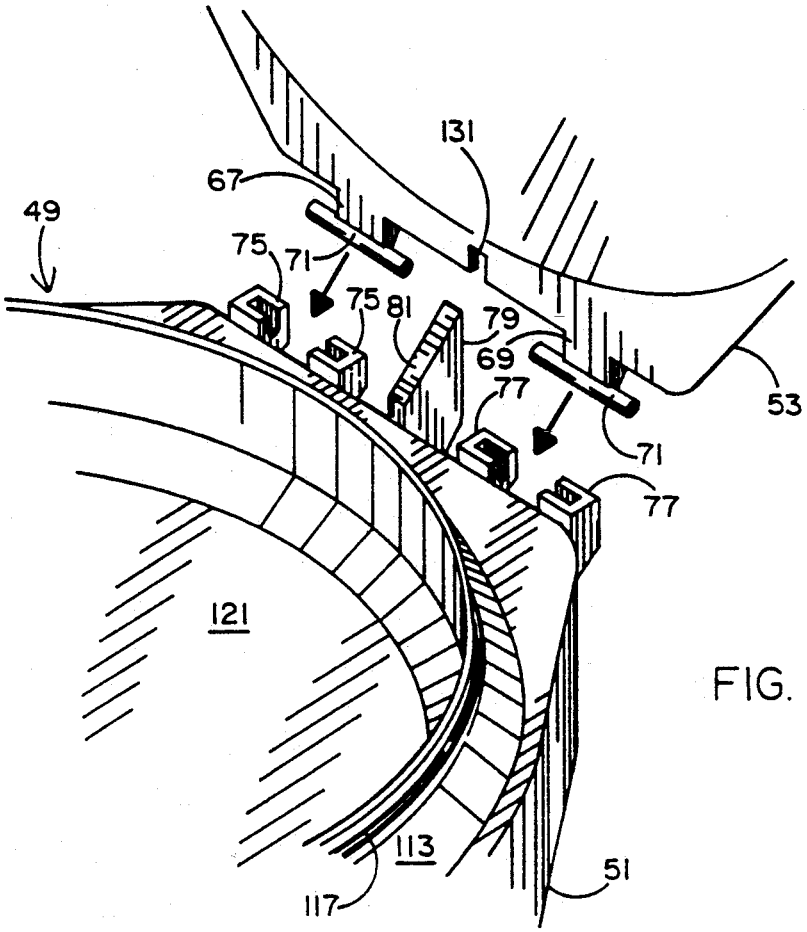
FIG. 9 is a perspective view of the centrifuge as shown in FIG. 8 illustrating a closeup of the hinged relationship of the lid, in detached position.

Referring to FIG. 9, a closeup view of the point of engagement of the lid 53 to the centrifuge housing 51 shows the detachment of the pair of pins 71 and 73 with respect to hinge sockets 75 and 77. In addition, with the design of the rear portion of the centrifuge, if the lid 53 is opened too roughly, detachment of the lid 53 from the centrifuge housing 51 will occur early, to avoid any damage to the lid 53, or its pivotal support structure.

Figure 10:
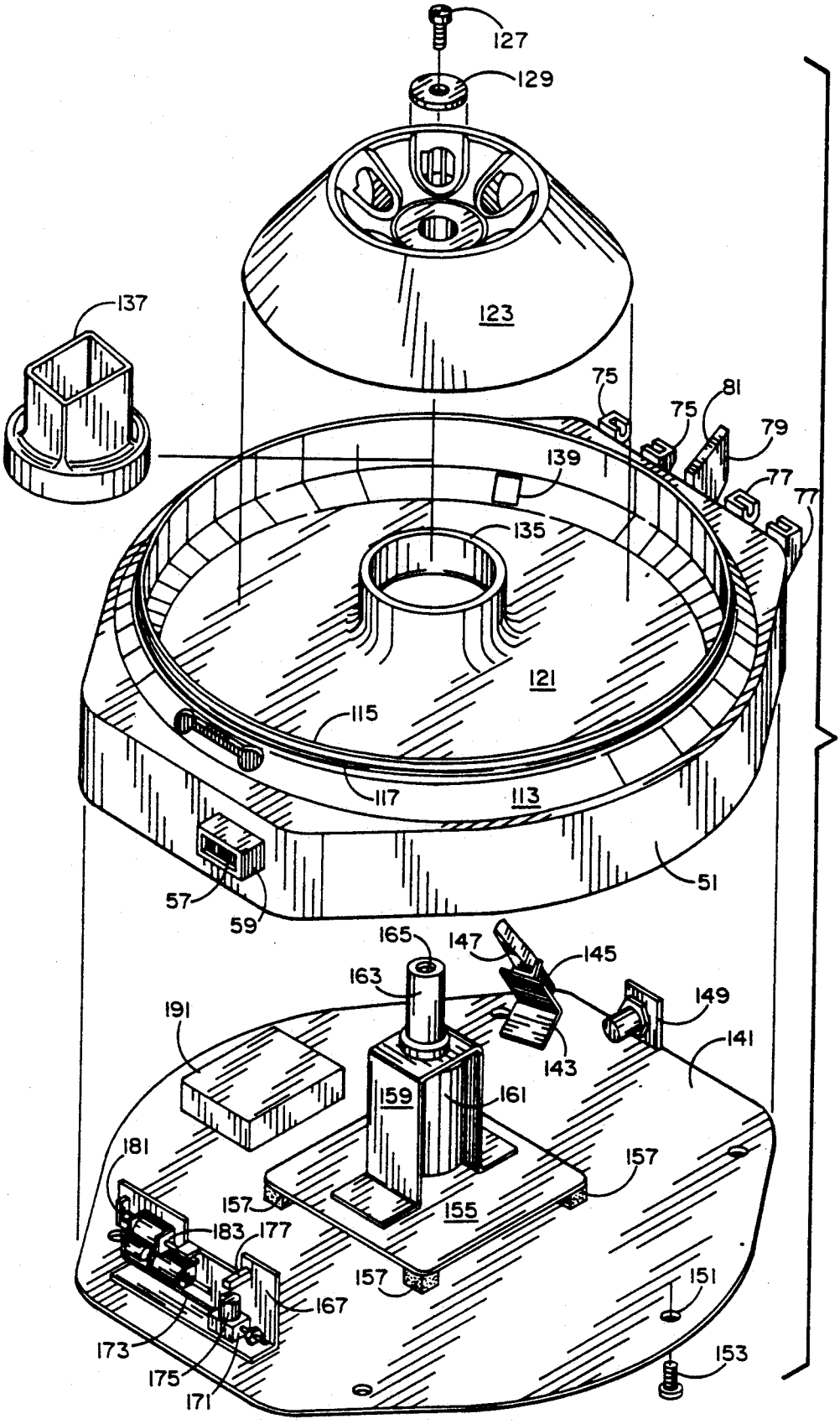
FIG. 10 is an exploded view of the centrifuge as shown in FIGS. 8 and 9, with the lid having already been removed, the centrifuge housing lifted from the centrifuge base.

Referring to FIG. 10, an exploded view of the centrifuge 49 reveals the inner details of its construction. At the center of centrifugal bowl 121 is a circular raised projection 135. A protective bellows 137, shown to one side, is circular at its lower portion and fittable over the circular raised portion 135. The structure formed when bellows 137 is fitted over circular raised projection 135 acts to prevent any liquids accidentally spilled or splashed in centrifugal bowl 121 from leaking into the area beneath the centrifugal bowl 121.

Within centrifugal bowl 121, and near the rear of centrifuge housing 51 is a rectangular aperture 139. Beneath the centrifuge housing 51 is a planar base 141. Near the rear of planar base 141, a dispersion mechanism, including a support 143, solenoid 145, and a disperser, or flicker 147, is mounted. The disperser, or flicker 147, when centrifuge 49 is assembled, extends through the aperture. Disperser 147 is generally wedge shaped, having a rectangular cross section at its base, and tapering to narrower rectangle near its tip end.

The rectangular aperture 139 does not rigidly engage the disperser 147 near the dispersers 147 base but allows both linear movement into and out of the rectangular aperture as well as some rotational movement within the rectangular aperture. The disperser 147 is attached to a round solenoid shaft (not yet shown), and could freely rotate but for the limiting presence of the rectangular aperture 139. The limited rotational movement will insure that the disperser 147 remains in a position to contact in a parallel fashion the end portion of the container 125, (not shown in FIG. 10) to provide energy to the container 125 to disperse the cells for later analysis.

Also at the rear of planar base 141 is illustrated a support 149 for the input power jack 91. A series of holes 151 about the periphery of the planar base 141 enable the engagement of the planar base 141 to the centrifuge housing 51 with a series of screws 153, or other fasteners, one of which is shown.

At the center of the planar base 141, a motor support plate 155 is supported by a series of vibration absorption pads 157. The pads 157 help to vibrationally isolate the planar base 141 from any vibrations which would otherwise emanate from motor support plate 155. A motor mounting bracket 159 secures a centrifuge motor 161 to the motor support plate 155. Motor 161 has a centrifuge shaft 163 which further has a threaded tap 165 to accommodate locking screw 127, in securing container support 123 to the centrifuge shaft 163.

Figure 22:
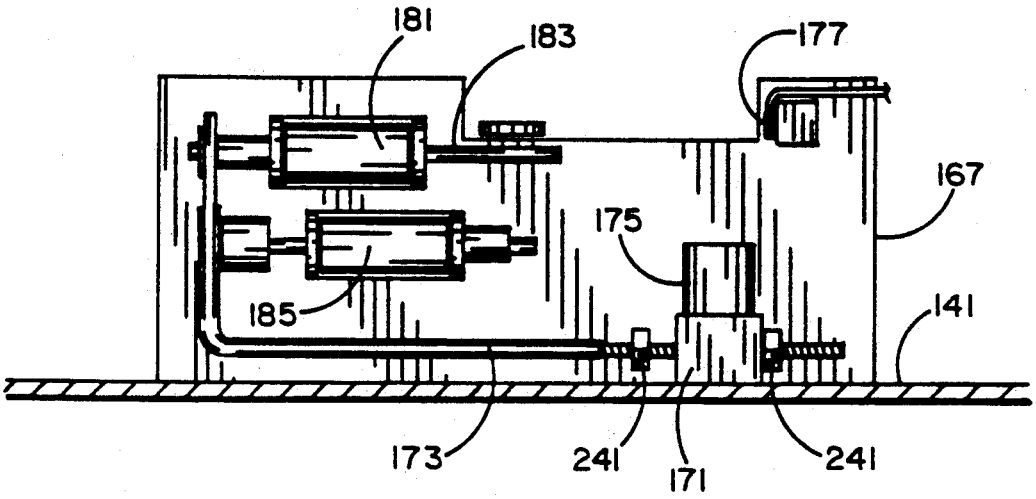
FIG. 22 is a frontal, partial sectional view of the latch mechanism shown in FIG. 10, illustrated without lid closure, and in the unlatched position.
Figure 23:
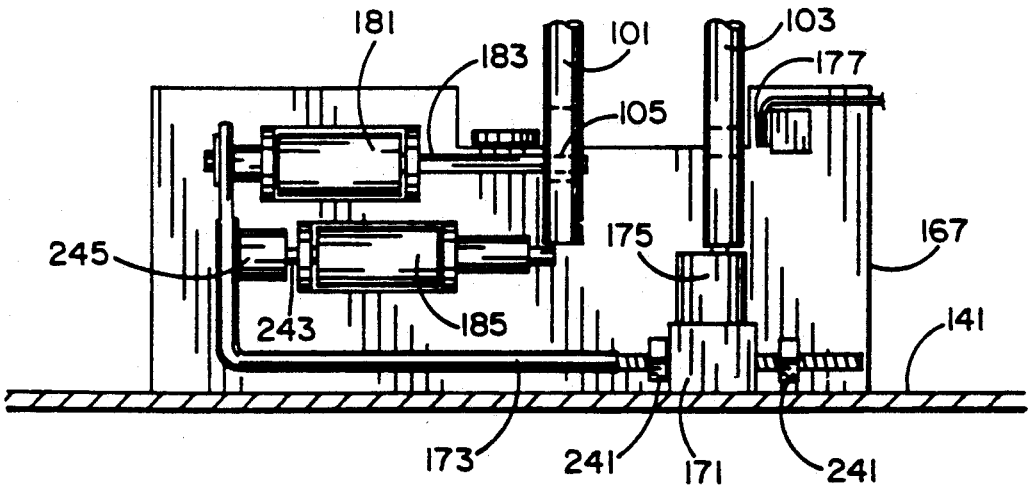
FIG. 23 is a frontal, partial sectional view of the latch mechanism as was shown in FIG. 22, illustrated with lid closure and lid elements in place, and in the latched position.

At the front of the planar base 141, a vertically standing latch bracket 167 supports structures which facilitate the closure and latching of the lid 53. Referring to FIGS. 22 and 23 in addition to FIG. 10, a base block 171 slidably supports a linkage rod 173. Atop base block 171 is affixed a magnet 175. Magnet 175 engages the tip end of latch rod 103 to urge lid 53 when shut to remain closed against the centrifuge housing 51.

Above the magnet 175 is situated a first "Hall Effect" sensor 177. Hall effect sensor 177 is situated to sense the presence of the magnetic material within the latch rod 103 when the lid 53 is closed onto the centrifuge housing 51. At the left side of vertically standing latch bracket 167, a closing solenoid 181, having a solenoid shaft 183, engages the vertical portion of the linkage rod 173. Below closing solenoid 181 is an opening solenoid 185, also engaging the vertical portion of the linkage rod 173. The end of solenoid shaft 183 opposite the end of solenoid shaft 183 engaging the linkage rod 173 is aligned to enter the aperture 105 once the closing solenoid 181 is energized. The opening solenoid 185 is configured to push linkage rod 173, and the solenoid shaft 185 to which it is connected in the opposite direction, to disengage solenoid shaft 183 from the aperture 105.

Referring once again to FIG. 10, a circuit portion 191 is also supported by the planar base 141. Although not seen from the overall layout of the structures supported by planar base 141, there are multiple electrical connections from those structures supported by planar base 141 and the circuit portion 191. Circuit portion 191 is electrically connected to the input power jack 91, the disperser solenoid 145, the centrifuge motor 161, an angular displacement "Hall Effect" sensor 186, mounted on the upper surface of the motor marking bracket 159, "Hall Effect" sensor 177, closing solenoid 181 and opening solenoid 185, and indicator switch 57 (connection not shown). In this configuration, all control is accomplished from the circuit portion 191, including the closing and opening of the lid latch rod 103, the power supplied to the centrifuge motor 161, the sensing of the angular displacement of the sample support holder 123 through the angular displacement "Hall Effect" sensor 186, the sensing of the opening and closing of the lid 53, and the control of the disperser solenoid 145.

Further, circuit portion 191 contains a microprocessor which is enabled to effect control of the centrifuge and enable the performance of a predetermined, prespecified centrifuge cycle. Therefore, circuit portion 191 can be programmed to affect any number of different control cycles, depending upon the particular task in which the centrifuge is utilized.

Figure 11:
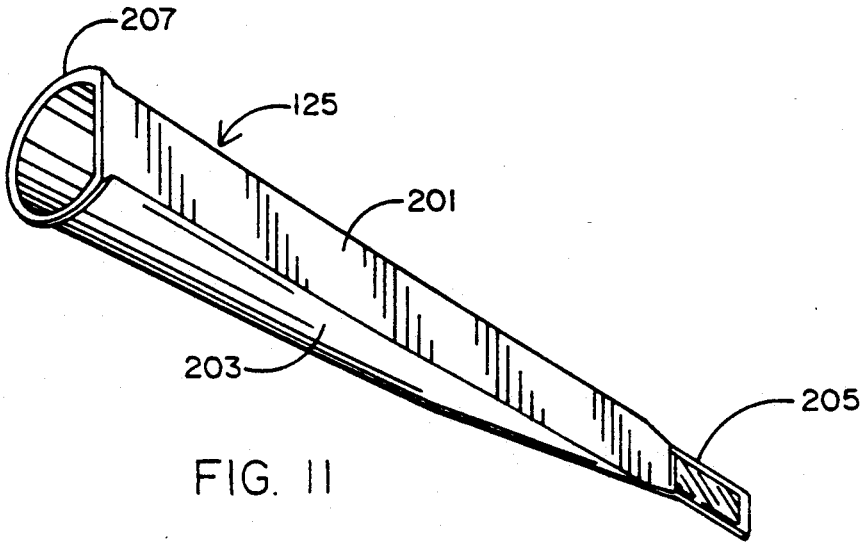
FIG. 11 is a perspective view of a sample holder utilizable with the centrifuge of FIGS. 1–10.

Referring to FIG. 11, a container 125 is illustrated in perspective. Container 125 has a flat portion 201 and a round portion 203. A bottom end 205 of the flat portion 201 of the container 125 forms a microscope viewable slide member. The advantages of the container 125 are more fully described in U.S. Pat. No. 5,030,421, referred to above. The bottom end 205 of the container 125 contains a reduced cross sectional area which is flattened to enable direct viewing with a microscope.

When the container 125 undergoes centrifugal acceleration, the relatively denser cells move, by virtue of their acceleration, to the bottom end 205 of the container 125. They are then more advantageously viewable not only because of their increased population of cells at the bottom end 205, but also by virtue of the fact that they are brought within an area so narrow that they are in the same focal plane. Container 125 has an upper rim 207 to provide an increased cross sectional upper profile, and limit the extent of insertion into container support 123.

Figure 12:
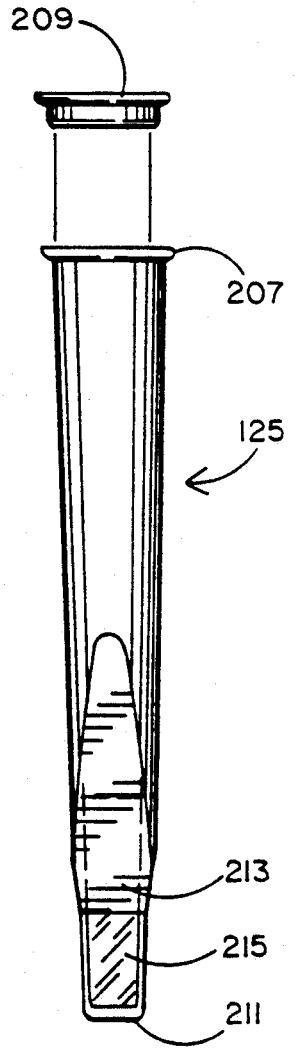
FIG. 12 is a frontal view of the sample holder illustrated in FIG. 11.

Referring to FIG. 12, a cup shaped stopper 209 is shown above the container 125. Also shown in FIG. 12 is a small solid end portion 211 at the bottom most end of container 125.

At the lower edge of the round portion 203, a beveled portion 213 provides a structured transition into the microscope slide member 215 in which the centrifuged cells would reside for viewing.

Figure 13:
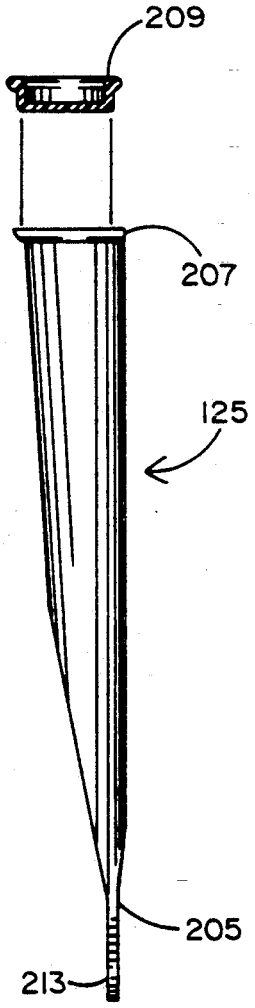
FIG. 13 is a side view of the sample holder illustrated in FIGS. 11 and 12.

Referring to FIG. 13, a side view of the container 125 better illustrates the flat nature of microscope slide member. Above the container 125 of FIG. 13, the stopper 209 is illustrated in sectional view.

Figure 14:
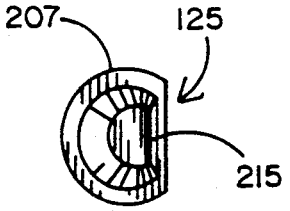
FIG. 14 is a top view of the sample holder illustrated in FIGS. 11, 12, and 13.

Referring to FIG. 14, a top view of container 125 illustrates the fact that the flattened portion 201 extends throughout the length of the container 125. Also viewable is an end view of the microscope member 215 which is located at the bottom of the container 125.

Figure 15:
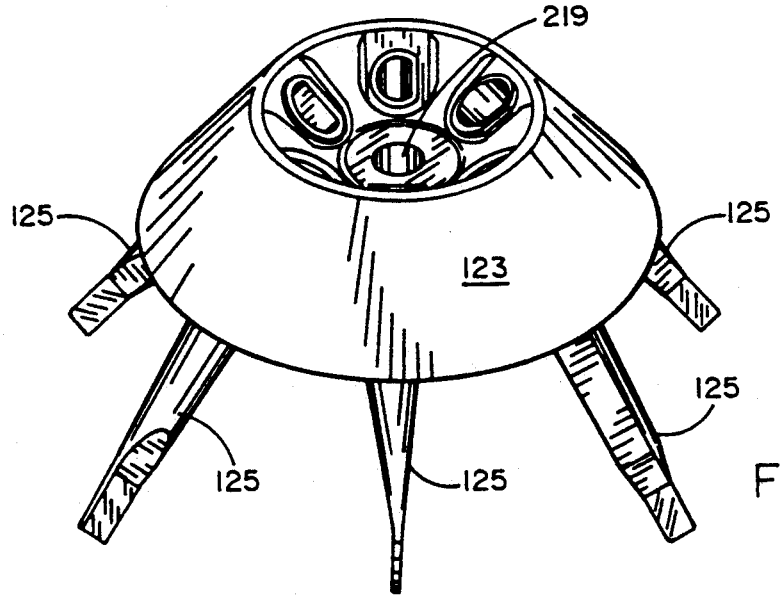
FIG. 15 is a perspective view of the sample holder support previously shown in FIGS. 8 and 10, fitted with the sample holders of FIGS. 11–14.

Referring to FIG. 15, a perspective view of the container support 123 illustrates an individual loading structure for each container 125. Note that each container 125 is oriented with the flat portion 201 always oriented, with respect to the center axis of each container 125, in a clockwise direction with respect to the container support 123. In this manner, each container 125 is forced to have a particular orientation with regard to container support 123, and therefore with regard to the centrifugal path created by the turning of container support 123.

The container 125 turn with a flat orientation regarding their path of travel. With the orientation shown in FIG. 15, and assuming a clockwise rotation, the flat portion 205 would lead the path of travel. It is desirable that the path of travel be flat, that the plane of the small solid end portion 211 be perpendicular to the path of travel, in order for the tube to be mechanically flicked or dispersed using the dispersion mechanism disclosed herein. Also shown more clearly in FIG. 15 is the central aperture 219 into which fits the centrifuge shaft 163.

Figure 16:
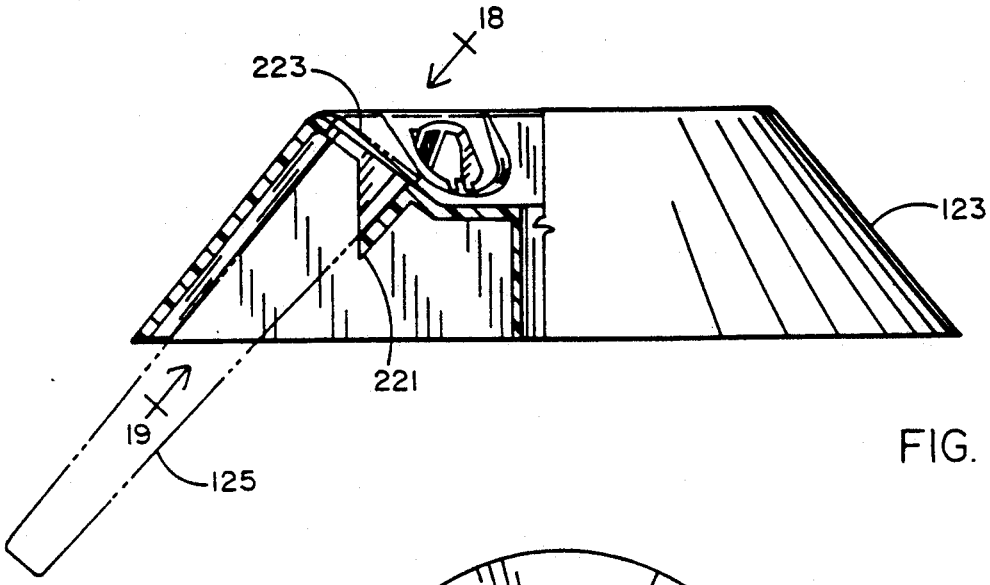
FIG. 16 is a partial sectional plan view of the sample holder support of FIG. 15 with the sample holder illustrated in phantom.

Referring to FIG. 16, a partial sectional view of container support 123 illustrates the support made available to the container 125, the container 125 shown in phantom. An integral spring projection 221 urgingly supports the container 125 from its bottom surface. Spring projection 221 urgingly ensures that the container 125 will be snugly held in place within the container support 123. The space into which the container 125 fits is the container aperture 223. Extending inwardly against container 125 beneath each container aperture 223 are a pair of rib segments 217 which provide support to container 125 on curved surface 203 and flat surface 201.

Figure 17:
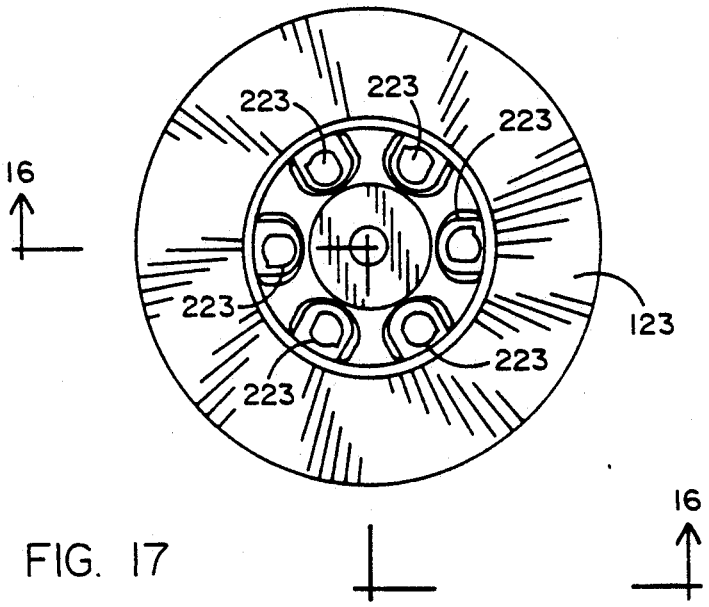
FIG. 17 is a top view of the sample holder support of FIGS. 8, 10, 15, and 16.
Figure 18:
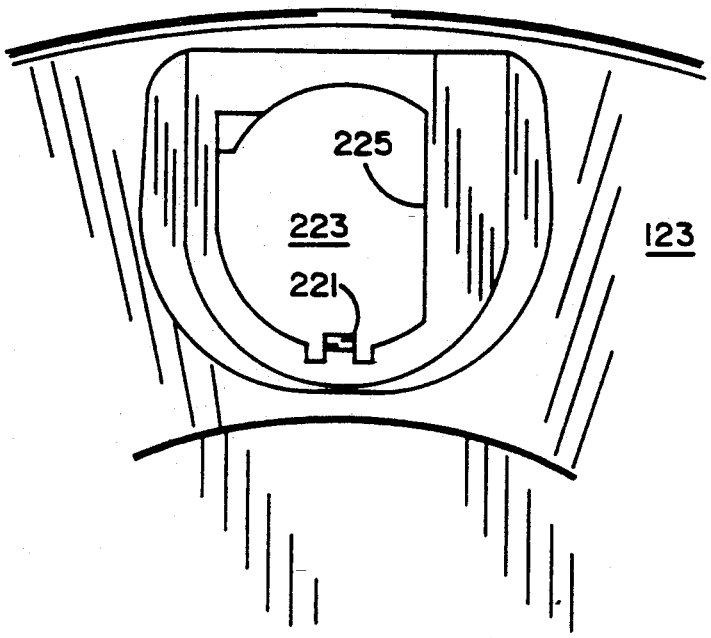
FIG. 18 is an upper view of the sample holder support of FIGS. 8, 10, and 15–17 illustrating an expanded top view of the sample holder aperture.

Referring to FIG. 17, a top view of the container support 123, again without the presence of the container 125, illustrates the shape of the container apertures 223. In FIG. 18, a closeup view of a single container aperture 223 illustrates the spring projection 221, and a flat surface 225 which complements the flat portion 201 of the container 125, and insures that the container 125 fits into the container support 123 in only one orientation. This feature is labor saving in that it eliminates the need to orient the container 125 each time they are loaded into the Censlide container support 123.

Figure 19:
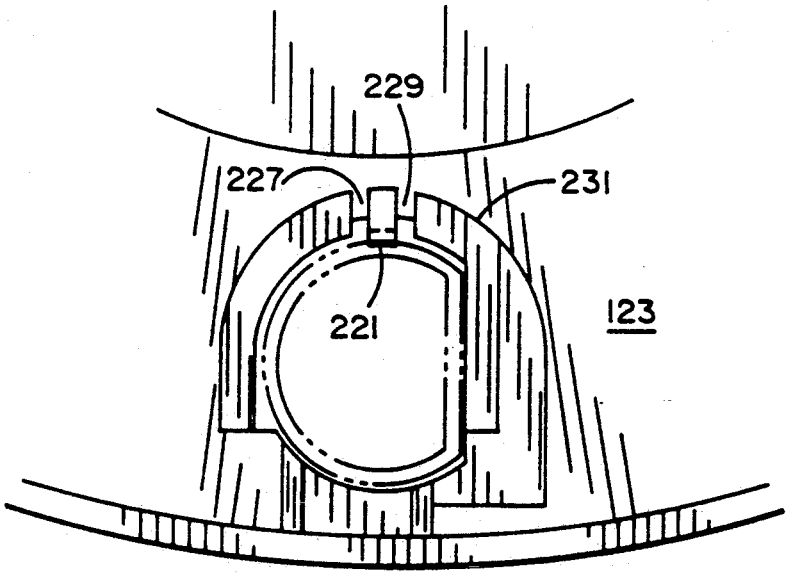
FIG. 19 is an underside view of the sample holder support of FIGS. 8, 10, and 15–18 illustrating an expanded underside view of the sample holder aperture.

Referring to FIG. 19, a bottom view of the container support 123, again without the presence of the container 125, and reverse to the view of FIG. 18, illustrates the shape and extent of the projection of the material surrounding the container apertures 223. The spring projection 221 is formed by forming a pair of slots 227 and 229 into a wall of material 231 surrounding the container aperture 223. Ideally spring projection 221 will project concentrically inward with respect to the axis of the container apertures 223, in order to springingly urge against the container 125 when the container 125 is present. Container 125 will be in contact and supported by rib segments 217 when present in aperture 223.

Figure 20:
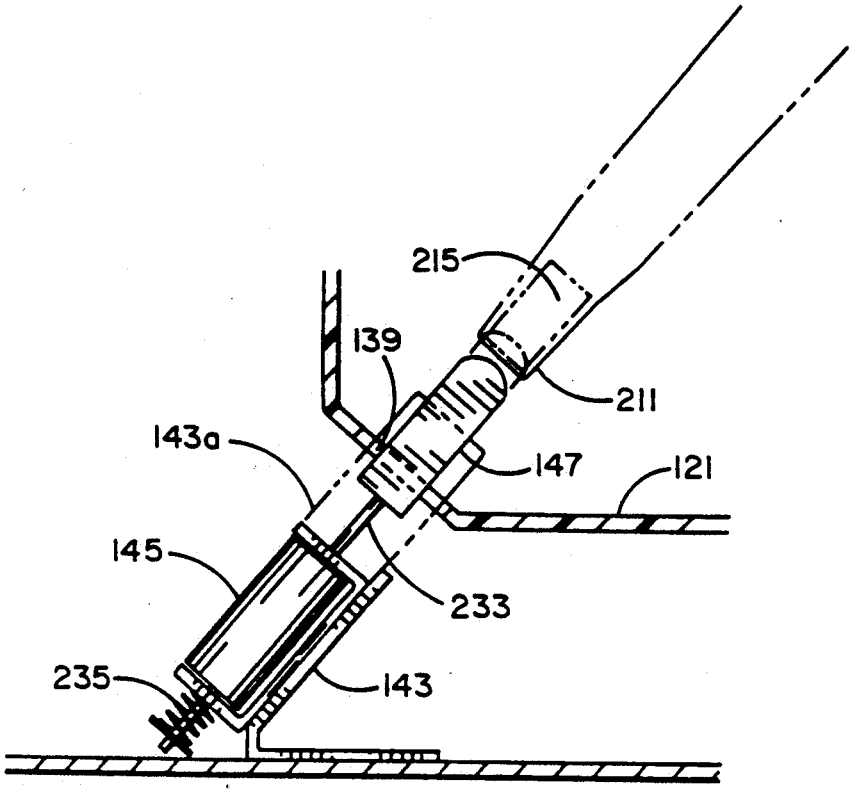
FIG. 20 is a side sectional view of the disperser shown supported by the base, and extending into the centrifuge housing, the position of the disperser in contact with the sample holders shown in phantom.

Referring to FIG. 20, a closeup view of the dispersion mechanism, including support 143, an optional guide 143*a* and solenoid 145, and disperser 147 is shown. The optional guide 143*a* will enable the use of an aperture 139 which is not as closely conforming to the cross section and shape of disperser 147.

The disperser 147 is clearly shown as mounted on a solenoid shaft 233, which was previously discussed. The disperser 147 is illustrated extending through the aperture 139 and into the centrifuge bowl 121 area. A spring 235 surrounds the solenoid shaft 233 at the end opposite the disperser 147 to urge the disperser 147 out of the centrifuge bowl 121 area. In this configuration, the solenoid shaft 233 is urged away from the centrifuge bowl area until the solenoid 145 is energized. When the solenoid 145 is energized, the solenoid shaft 233, and the attached disperser is urged into the centrifuge bowl 121 area, and into contact with the small solid end portion 211. This contact position is illustrated in phantom.

Figure 21:
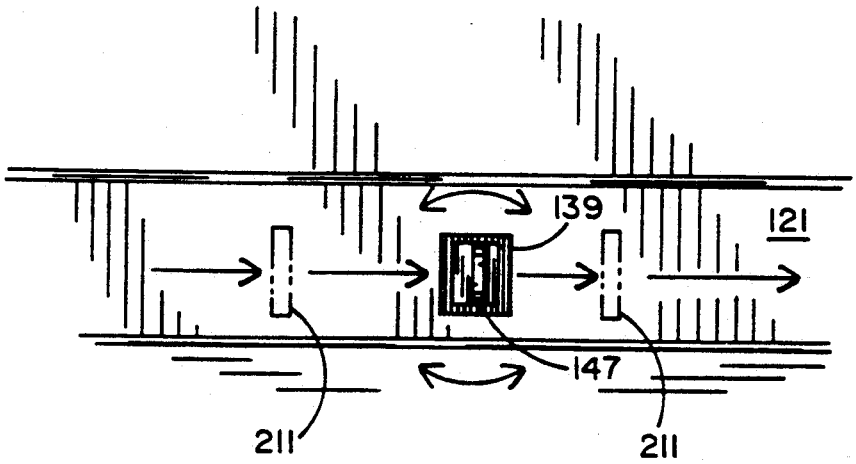
FIG. 21 is a frontal view of the disperser of FIG. 20 taken with respect to a point inside the centrifuge housing, the relative movement of sample holders shown in phantom.

FIG. 21 is a view of the disperser 147 from the inside of the centrifuge bowl 121 area. Note that the cross sectional area of the disperser 147 is less than the cross sectional area of the aperture 139 and that it is located a small distance from guide 143*a*. The clearance formed by the differences in cross sectional area and the space between disperser 147 (and optional guide 143*a* if present) enables the disperser to be angularly displaced about the axis of the solenoid shaft 233 a small amount. In this configuration, and with the ability to twist slightly about the solenoid shaft 233 axis, the oncoming small solid end portion 211 of the container 125 may strike the disperser 147 at its top or bottom edge, as well as flatly. Depending upon the extent of angular twist, and from geometry, the upper or lower edge of the disperser 147 may initially strike the small solid end portion 211 of container 125 at different points along the length of the small solid end portion 211. Such a changing initial strike point along the length of small end portion provides for a more varied and even dispersion of the cells at the bottom of the container 125.

Figure 21A:
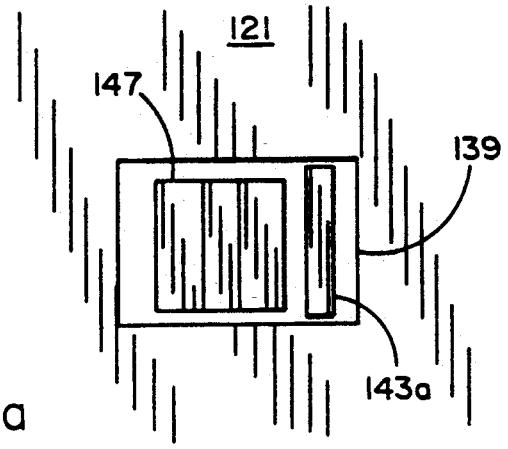
FIG. 21*a* is enlarged view of an alternative flicking mechanism utilizing a guide to limit axial rotational of the disperser shown in FIG. 21.
Figure 21B:
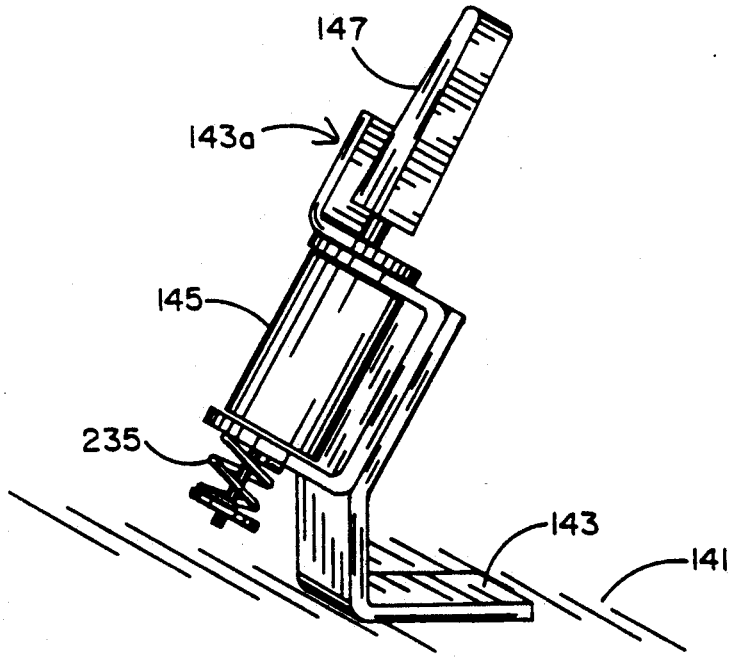
FIG. 21*b* is an enlarged perspective view of the disperser mechanism illustrating further details of the guide of FIG. 21*a;*

Referring to FIG. 21*a*, an expanded view of the dispersion mechanism, including the guide 143*a* is illustrated with respect to the bowl portion 121 and base portion 141. FIG. 21*b* is a perspective view of the disperser assembly illustrating the guide 143*a*.

Referring to FIG. 22, a closeup of latch bracket 167 and the structures it supports, including base block 171, linkage rod 173, magnet 175, first "Hall Effect" sensor 177, closing solenoid 181, solenoid shaft 183, and opening solenoid 185, are shown. The portion of linkage rod 173 extending through the base block 171 is threaded, and fitted with linear displacement limiting nuts 241. Note also that the solenoid shaft 183 is connected into the vertical portion of linkage rod 173.

Opening solenoid 185 has a solenoid shaft 243, and an expanded portion 245 on solenoid shaft 243 for urging the vertical portion of linkage rod 173 away from the base block 171. In FIG. 22, the latching structures are in the open position, ready to accept the closure of lid 53 and the presence of latch rods 101 and 103.

Referring to FIG. 23, when the lid 53 is closed, the latch rod 103, during the last portion of its displacement toward magnet 175 the attraction from magnet 175 urges the latch rod 103 and therefore the lid 53 to the full extent of its closure. As the lid 53 is fully closed, the magnetic portion of the latch rod 103 is sensed by the first "Hall Effect" sensor 177, and the presence of a magnetic field is reported to the circuit portion 191.

Once the lid is closed, upon actuation of indicator switch 57, the circuit portion 191 can actuate the closing solenoid 181 to cause the solenoid shaft 183 to enter the aperture 105 of latch rod 101. Once solenoid shaft 183 enters the aperture 105 of latch rod 101, the lid 53 is latched and locked to the centrifuge housing 51. Typically, once latched, the centrifuge 49 will automatically execute a single centrifuge cycle. Once the cycle is finished, the solenoid 185 is activated to urge linkage rod 173 away from the base block 171, which in turn urges solenoid shaft 183 away from engagement with aperture 105, thus unlatching the lid 53.

Figure 24:
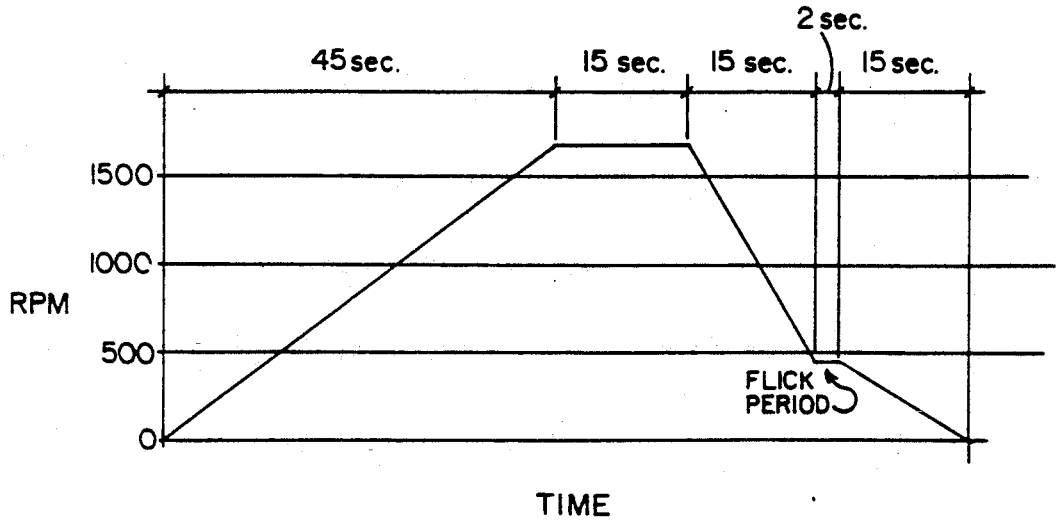
FIG. 24 is a graphical diagram of the centrifuge processing cycle for the centrifugation of a urine sample.

Referring to FIG. 24, a typical centrifugation cycle for the centrifugal collection of cells in urine is shown. This cycle will be discussed in conjunction with the operation of the centrifuge 49. First, the containers 125 are placed into the container support 123 in a balanced fashion, meaning that the tubes are filled to about the same level, and that either two, four or six tubes are loaded into the container support 123.

Once the containers 125 are placed into the container support 123, and assuming that an energized power supply male jack (not shown) is inserted into the input power jack 91, the operator closes the lid 53, which is sensed by the circuit portion 191. The operator then presses the indicator switch 57 to start the cycle. The indicator lamp lights to indicate the start of the cycle. At the beginning of the cycle, and once the closure of the lid 53 is sensed, and the cycle is initiated, the circuit portion 191 energizes solenoid 181 to latch the lid 53 shut.

Referring again to FIG. 24, the cycle begins by energizing centrifuge motor 161 and causing the container support 123 to begin its angular displacement and increase its angular speed. The speed is ramped up to about 1650 revolutions per minute over a time span of about 45 seconds. Once a speed of 1650 revolutions per minute is attained, this speed is maintained for about 15 seconds. After maintaining this speed for 15 seconds, the speed is ramped down to a speed of between about 400 to about 500 revolutions per minute. Once this speed of about 400 to about 500 revolutions per minute is attained, the dispersion of the material in the containers 125, or flicking occurs. The solenoid 145 is energized, and the disperser 147 is brought into contact with the small solid end portion 211 of the containers 125. Preferably, each tube will be flicked 15 times. The flicking is controlled by circuit portion 191 and the angular displacement sensed by the second "Hall Effect" device mounted near the motor mounting bracket 159. During flicking, the disperser 147 acts to slow the container support 123, but the circuit portion 191 acts to maintain the rate of angular displacement at from 400 to 500 revolutions per minute.

Once the desired flicking has been accomplished, the solenoid 145 is de-energized and the disperser 147 is removed from contact with the containers. The flicking operation requires about 2 seconds. Next, the speed is ramped down from a speed of from about 400 to 500 revolutions per minute to zero revolutions per minute, over the course of about 15 seconds. During this portion of the cycle, the indicator switch flashes. Once the cycle is complete, and the container 123 is brought to a stop, the indicator lamp shuts off, the solenoid 185 is energized, the linkage rod 171 urges the solenoid shaft 183 out of engagement with the latch rod 101, and the lid 53 is openable.

As, the latching mechanism will be of small size to fit into the compact centrifuge, the flat portion 61 and linear lip 63 are designed to only slightly overhang the flat portion 61 of centrifuge housing 51 so that undue lifting pressure will not normally be exerted upon the lid 53. In this configuration, the latch mechanism will be protected from operator abuse.

Circuit portion 101 is designed to allow the lab technician to abort a cycle up to initiation of the flicking portion of the cycle by pressing the lighted indicator switch 57. Upon doing so the indicator switch 57 flashes intermittently and when the container support 123 comes to rest the lighted indicator switch 57 goes off. Circuit portion 191 is also designed to require the lab technician to lift the lid 53 at the end of each cycle prior to initiation of a new cycle. The lid must be lifted at the end of either a complete cycle or an aborted one. Circuit portion 191 is designed to activate solenoid 185 upon initial energizing to insure that lid 53 is operable.

Referring to FIGS. 25*a* and 25*b*, a perspective and a sectional view of an adaptor 501 are illustrated. The upper portion of the adaptor 501 has a lip portion 503 to limit its extension into the container support 123. A typical, cylindrically shaped centrifuge tube, or ordinary test tube, can then be fitted to rest within the adaptor 501, and the centrifuge 49 utilized in a conventional manner.

Referring to FIG. 26, a side sectional view of the adaptor 501 illustrates that the lower extent of the adaptor 501 has adequate clearance with respect to the disperser 147, that even if disperser 147 is accidentally or unintentionally activated, there will be no contact between the disperser 147 and the bottom of the adaptor 501.

Although the invention has been described with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. An automated centrifuge comprising:

a housing;

drive means, within said housing, for centrifugally accelerating and decelerating at least one container, the container holding a liquid;

control means electrically connected to said drive means for controlling a cycle including ramping up to a first speed, holding said first speed for a predetermined time period, ramping down to a second speed, exposing a portion of the liquid in the container to dispersing action and then slowing to a stop.

2. The automated centrifuge of claim 1 wherein a portion of the liquid in the container is dispersed by flicking.

3. The automated centrifuge of claim 2 wherein said control means controls the dispersing of the portion of the liquid in the container by flicking while the container is driven at a substantially constant speed.

4. The automated centrifuge of claim 2 wherein said control means controls the dispersing action by flicking the container a predetermined number of times.

5. The automated centrifuge of claim 2 wherein said control means is enabled to ramp said drive means up to a first speed, hold said drive means at the first speed for a predetermined time period, ramp said drive means down to a second speed, control said exposure of a portion of the liquid in the container to dispersing action by flicking and then slow said drive means to a stop during a time period of from about one minute and a half to about two minutes.

6. The automated centrifuge of claim 1 wherein said first speed is about 1650 revolutions per minute, and said second speed is from about 400 to about 500 revolutions per minute.

7. The automated centrifuge of claim 1 wherein said container is a Censlide container.

8. The automated centrifuge of claim 1 further comprising a switch mechanism, supported by said housing and electrically connected to said control means, for initiating operation of said control means.

9. The automated centrifuge of claim 8 wherein said switch mechanism is an indicator switch, and wherein said control means also illuminates said lighted switch upon the initiation of said cycle.

10. The automated centrifuge of claim 8 wherein said switch mechanism includes an indicator switch, and wherein said control means also functions to halt said cycle when the switch mechanism is contacted during the cycle.

11. The automated centrifuge of claim 8 wherein said housing is an openable housing, and wherein said switch mechanism includes an indicator switch, and wherein said control means prevents operation of the centrifuge when the housing has not been opened following a previous operation.

12. The automated centrifuge of claim 8 wherein said switch mechanism includes an indicator switch, and wherein said control means also terminates illumination of said lighted switch upon the completion of the cycle.

13. The automated centrifuge of claim 8 wherein said control means also independently controls the actuation of dispersing action in any cycle.

14. A centrifuge comprising:

a base;

a drive motor, supported by said base, and having a vertically oriented shaft;

control means, electrically connected to said drive motor, for controlling said centrifuge;

a housing, fittable over said base and having an annular tube compartment;

a lid, pivotally attached to said housing and enclosing said annular tube compartment;

a tube holder, supported by said shaft of said drive motor within said annular tube compartment;

flicking means, supported by said base and said housing, for selectively being brought sufficiently close to said tube holder in order to flick any tubes present in said tube holder.

15. The centrifuge of claim 14 wherein the portion of said flicking means which flicks said tube is flexible.

16. The centrifuge of claim 14 further comprising:

an adaptor, fittable within said tube holder, and having an internal space sufficient to accept a cylindrically shaped test tube.

17. The centrifuge of claim 14 further comprising:

means, within said housing, for urging said lid in a closed position with respect to said housing.

18. The centrifuge of claim 14 further comprising:

means, within said housing, for maintaining said lid in a closed position with respect to said housing when said centrifuge is in operation.

19. The centrifuge of claim 18 wherein said means for maintaining said lid in a closed position further comprises:

a first latch rod, having a magnetic portion, connected to said lid, and extendable into a first opening within said housing with the closing of said lid with respect to said housing;

a second latch rod, having a transverse aperture portion, connected to said lid, and extendable into a second opening within said housing with the closing of said lid with respect to said housing;

a first solenoid having a solenoid shaft in alignment with said transverse aperture portion of said second latch rod, and electrically connected to said control means and triggerable to urge said solenoid shaft of said first solenoid into said transverse aperture;

a second solenoid having a solenoid shaft engaged to urge said solenoid shaft of said first solenoid out of said transverse aperture; and a hall effect sensor, electrically connected to said control means, and mounted within said housing proximate a path of entry of said first latch rod into said first opening into said housing, to enable said control means to sense the closing of said lid upon said housing and to energize said first solenoid to lock said lid upon the initiation of a centrifuge cycle, and to unlock said lid upon the completion of a centrifuge cycle.

20. The centrifuge of claim 14 further comprising:

means, supported by said housing, for forming a seal between said lid and said housing, when said lid is in a closed position with respect to said housing.

21. The centrifuge of claim 14 wherein said lid is manually removable from and re-attachable to said housing, at a point of pivotal attachment to said housing.

22. The centrifuge of claim 14 wherein said housing defines an aperture connecting said base and said annular tube compartment and wherein said flicking means further comprises:

a solenoid attached to said base and electrically connected to said control means, and having a solenoid shaft displaceable in the direction of said tube holder; and a flexible member attached to the end of said solenoid shaft and displaceable, with said solenoid shaft, in the direction of said tube holder and through said aperture.

23. The centrifuge of claim 22 wherein said aperture limits the rotation of said solenoid shaft and said flexible member about the axis of said solenoid shaft.

24. The centrifuge of claim 22 further comprising:

a first magnet supported by said tube holder; and a hall effect sensor, electrically connected to said control means, and located proximate to said tube holder and triggerable by said first magnet by the rotation of said tube holder.

25. The centrifuge of claim 22 wherein a portion of said lid overlies said housing to form a lip to facilitate the limited application of manual pressure in opening said lid.

26. The process for automatically centrifuging at least one container comprising the steps of:

placing a container in a rotatable support;

increasing the angular displacement of said rotatable support from a stopped position to an angular displacement of about 1650 revolutions per minute;

maintaining said angular displacement of about 1650 revolutions per minute for about 15 seconds;

decreasing the angular displacement of said rotatable support from said angular displacement of about 1650 revolutions per minute to from about 400 to about 500 revolutions per minute;

flicking each said at least one container a predetermined number of times during said about 400 to about 500 revolutions per minute angular displacement; and decreasing the angular displacement of said rotatable support from said angular displacement of from about 400 to about 500 revolutions per minute to an angular displacement of zero revolutions per minute.

27. The process for automatically centrifuging at least one container as recited in claim 26 wherein each of said decreasing the angular displacement steps and increasing the angular displacement steps are performed linearly.

28. The process for automatically centrifuging at least one container as recited in claim 26 wherein said increasing the angular displacement of said rotatable support from a stopped position to an angular displacement of about 1650 revolutions per minute is performed in about 45 seconds, and wherein said decreasing the angular displacement of said rotatable support from said angular displacement of about 1650 revolutions per minute to from about 400 to about 500 revolutions per minute is performed in about 15 seconds, and wherein said decreasing the angular displacement of said rotatable support from said angular displacement of from about 400 to about 500 revolutions per minute to an angular displacement of zero revolutions per minute is performed in about 15 seconds.

29. A centrifuge for exposing one or more liquid containing tubes mounted in a tube holder to angular motion comprising:

a. a bowl shaped portion, the bowl shaped portion having an upper and a lower surface, b. a drive motor having a shaft extending therefrom, the drive motor mounted on said bowl shaped portion such that the shaft extends through the bowl shaped portion above and perpendicular to the upper surface thereof, c. the tube holder mounted on said drive shaft above the upper surface of the bowl shaped portion, d. a housing surrounding the bowl shaped portion and a movable lid attached to said housing, the combination of the housing, the bowl shaped portion and lid in a first configuration enclosing the tube holder, the tube holder being free to rotate within the housing and lid combination, and the housing, bowl shaped portion and lid in a second orientation allowing the insertion and removal of tubes into the tube holder, e. a control means for controlling the speed of the drive motor to a sequence of preset speeds, each speed being held for a preset period of time, the control means also maintaining the housing, bowl shaped portion and lid in the first orientation until the sequence is completed or aborted, f. the centrifuge further including means to impart dispersing energy to the liquid contained in the tubes during the sequence, said imparted dispersing energy functioning to more uniformly disperse particles within the tube to create a uniform distribution of the particles across a viewing portion incorporated within the tube, the control means also functioning to start and stop the delivery of said energy during a predetermined portion of the controlled sequence.

30. An improved centrifuge for imparting angular motion to at least one liquid containing tube placed therein, the improvement comprising:

a control means for controlling the amount of angular motion imparted to the liquid containing tube to a preset sequence of speeds and times, and an energy delivery device mounted within the centrifuges, the energy delivery device positioned to impart dispersing energy to the contents of a defined portion of each tube for a controlled period of time during the preset sequence, said dispersing energy causing redistribution of particles within the liquid enclosed in the defined portion.

31. The improved centrifuge of claim 30 wherein the preset sequence comprises increasing the angular motion until a first speed is reached, maintaining the first speed for a first preset period of time, reducing the angular motion until a second speed is reached, maintaining the second speed for a second preset period of time and then reducing the angular motion to zero.

32. The improved centrifuge of claim 31 wherein the dispersing energy is imparted during the second preset period of time.

33. The improved centrifuge of claim 32 wherein the dispersing energy is a flicking action imparted to the tube, the flicking action imparted about 15 times during about a 2 second period.

34. The improved centrifuge of claim 31 wherein the increasing angular motion occurs over a period of about 45 seconds, the first speed is about 1650 RPM and the first preset period is about 15 seconds, the reduction of angular motion from 1650 RPM occurs over a period of about 15 seconds, the second speed is from about 400 to about 500 RPM, the second preset period is about 2 seconds and the reduction of angular motion to zero occurs over about 15 seconds.

* * * * *